United States Patent [19]

Keller

[11] 4,308,964

[45] Jan. 5, 1982

[54] MAGAZINE RACK

[75] Inventor: Nicholas W. Keller, Lower Burrell, Pa.

[73] Assignee: Action Industries, Inc., Cheswick, Pa.

[21] Appl. No.: 63,160

[22] Filed: Aug. 2, 1979

[51] Int. Cl.[3] ..... A47F 3/14

[52] U.S. Cl. ..... 211/126; 211/189

[58] Field of Search ..... 211/126, 132, 195, 189; 248/152, 174; 312/108, 111; 217/12 R, 13, 65; 5/99 B

[56] References Cited

U.S. PATENT DOCUMENTS

| | | | |
|---|---|---|---|
| 185,960 | 1/1877 | Powers | 5/99 B |
| 747,562 | 12/1903 | Moody | 5/99 B X |
| 1,061,297 | 5/1913 | Johnson | 217/12 R |
| 1,086,951 | 2/1914 | Stocker | 217/12 R |
| 1,809,523 | 6/1931 | McLean | 211/132 |
| 2,257,536 | 9/1941 | Roycroft | 211/126 |
| 3,131,829 | 5/1964 | Masser | 312/111 |

*Primary Examiner*—J. Franklin Foss

*Attorney, Agent, or Firm*—Parmelee, Miller, Welsh & Kratz

[57] ABSTRACT

A magazine rack which may be disassembled into only four component parts to facilitate transportation and storage. The magazine rack may be assembled without separate fastening means, and due to its unique configuration no separate base or floor section is required.

2 Claims, 4 Drawing Figures

MAGAZINE RACK

BACKGROUND OF THE INVENTION

This invention relates to household furniture and, in particular, to racks for holding magazines and the like.

In the manufacture of furniture, the conventional practice, when assembling the various sections of a particular piece of furniture, is to permanently fix these sections to one another by means, for example, of a screw, nail or adhesive. While this mode of construction usually allows for the production of a sturdy, durable piece of furniture, it does have certain disadvantages. That is, the process of permanently connecting the component sections of a piece of furniture to one another in the aforedescribed manner is a time-consuming and laborious procedure, to which a substantial portion of the overall cost of manufacturing the piece of furniture may be attributed.

Additionally, furniture constructed in this manner may be relatively expensive to transport and store due to the cumbersome and distended configurations of many pieces of permanently assembled furniture. Close, efficient packing of such furniture, on a carrier or in a warehouse, thus may not be feasible. Consequently, relatively large amounts of carrier and warehouse space might have to be devoted to the transport and storage of permanently assembled furniture, thus also significantly increasing the cost of such furniture. For the same reason, retail stores dealing in furniture may have to allot excessive amounts of valuable floor space to the storage and display of permanently assembled furniture. In further reference to the problem of transporting permanently assembled furniture, it should also be noted that increasing numbers of consumers are required by their occupations to frequently move their households from one part of the country to another. Therefore the high cost of transporting a piece of permanently assembled furniture may have to be incurred not only before it is purchased by the consumer but also on a regular basis thereafter.

Another disadvantage associated with conventional, permanently assembled furniture is that such furniture is usually constructed from a large number and variety of component parts or sections. This production of such a variety of component parts is also a costly procedure. Where these parts are manufactured by molding a plastic, the incorporation of a wide variety of parts in a particular unit of furniture may be particularly expensive since each of these types of parts will require its own mold, which molds are generally only acquired at a substantial cost. Another problem resulting from the use of a large number of parts or sections in a particular unit of furniture is that the cost of assembling the furniture may, if course, increase in relation to the number of parts used. Such assembly costs may increase at a particularly rapid rate where parts are not designed so as to alleviate the necessity that they be oriented in one way, and one way only, before they may be correctly attached to their connecting part. In the case of conventional magazine racks, for example, at least two separate end panels, two separate side panels and a separate floor or base section are usually required as component parts. Further, a large number of fasteners may also be required to connect these component parts to one another. In many cases these side panels and end panels are themselves, made up of a large number of other component parts such as wooden slats or struts, thus still further complicating the construction of conventional magazine racks. It is also true that, in many cases, these side and end panels may not be interchanged with one another so that they may be oriented in only one way before the magazine rack may be satisfactorily assembled.

U.S. Pat. No. 3,606,950 discloses a magazine rack having side walls and end and floor panels. These walls and panels are hingedly interconnected so as to be foldable between a generally flat storage position and an open position in which it will support magazines. Step blocks are required to hold this magazine rack in this open position. This magazine rack has certain advantages over conventional, permanently connected magazine racks in terms of the ease by which it may be transported and stored, but it may lack the stability, durability and rigidity which usually characterize such conventional magazine racks. This folding magazine rack may also have no advantage over conventional, permanently assembled magazine racks in terms of the cost of its production.

It is, therefore, an object of the present invention to provide a sturdy and durable magazine rack which may be economically assembled from a minimum of types and number of component parts and which may be assembled without need of any separate fastening means or adhesive.

It is a further object of the present invention to provide a magazine rack which may be readily disassembled, then reassembled, so as to allow for its efficient storage and transport.

SUMMARY OF THE INVENTION

The present invention is a magazine rack which may be assembled without use of separate fastening means and which may be readily disassembled for storage or transport. The rack is comprised of two end panels and two side panels which are preferably connected to the end panels by means of a dovetailed tongue and groove joint. The side panels are equipped at their lower ends with integral, inward extending ledges so that a floor or base article retaining surface is formed without need of a separate panel for that purpose.

DESCRIPTION OF THE PREFERRED EMBODIMENT

Figure 1:
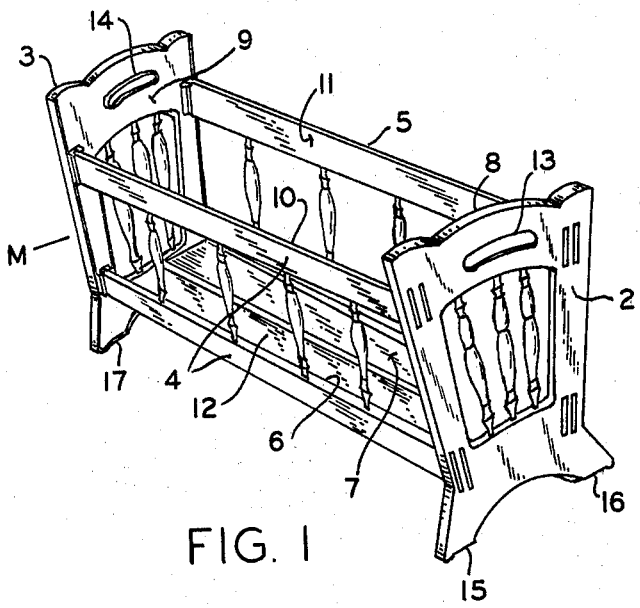
FIG. 1 is a perspective view of the magazine rack of the present invention.

Referring to FIG. 1, the magazine rack M of the present invention is comprised of a front end panel 2 and a rear end panel 3 and two side panels 4 and 5. The side panels 4 and 5 are connected edgewise to the end panels 2 and 3. The side panels 4 and 5 also have, respectively, integral base ledges 6 and 7, which extend inwardly so as to form a floor for the magazine rack M. Thus, while conventional magazine racks are constructed from pairs of side and end panels as well as a separate base or floor panel, the magazine rack of the present invention is assembled without the need of such a separate base panel. The magazine rack of the present invention may be constructed without the use of the many connecting means often required to assemble conventional, permanently assembled magazine racks. It is, therefore, apparent that even in terms of the number of component parts required for its assembly, the magazine rack of the present invention possesses certain advantages over conventional magazine racks. It will be observed, then, that with only four component parts, there is provided a front article retaining surface 8, a rear article retaining surface 9, two side article retaining surfaces 10 and 11 and a base article retaining surface 12.

In the front end panel 2 there is also a front hand grip aperture 13, and in the rear end panel 3 there is a rear hand grip aperture 14. By means of these hand grip apertures the magazine rack may be conveniently lifted and moved. The front end panel 2 also has a pair of integral legs 15 and 16. These legs together with an integral leg 17 and another integral leg 18 (FIG. 2) on the rear end panel 3, are the supports on which the magazine rack M rests.

Another advantageous feature of the present invention is that the end panels 2 and 3 are identical to one another, as are the side panels 4 and 5. Thus, only two types of parts are needed to construct this magazine rack. It will also be appreciated that because the two end panels and the two side panels are identical, respectively, to each other, the orientation of these panels during the assembly of this magazine rack is also simplified.

Figure 2:
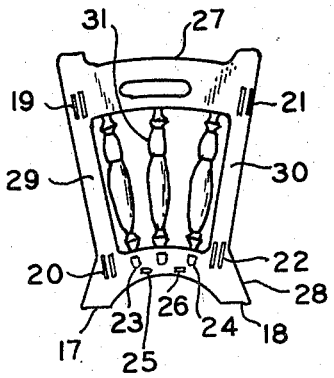
FIG. 2 is a front elevational view of an end panel of the magazine rack shown in FIG. 1.

FIG. 2 shows an end panel, one of the two above mentioned type of parts. While this figure shows the rear end panel 3, the front end panel 4 is similarly configured. In addition to the rear hand grip aperture 14 and the integral legs 17 and 18, the rear end panel 3 is equipped with four vertically extending side panel receiving grooves 19, 20, 21 and 22. These grooves are dovetailed and groove 19 is aligned with groove 20 and groove 21 and aligned with groove 22. Projecting from the rear article retaining surface 9 are two resilient stops 23 and 24 and two other stops 25 and 26. As will hereinafter be more fully explained, these stops serve to secure the side panels 4 and 5 in position after they have been connected with the end panels. For decorative purposes or for the purpose of conserving materials or reducing its weight, portions of the end panel may be cut away so that it comprises an upper slat 27, a lower slat 28, two vertical side slats 29 and 30, and a plurality of vertical struts as at 31.

Figure 3:
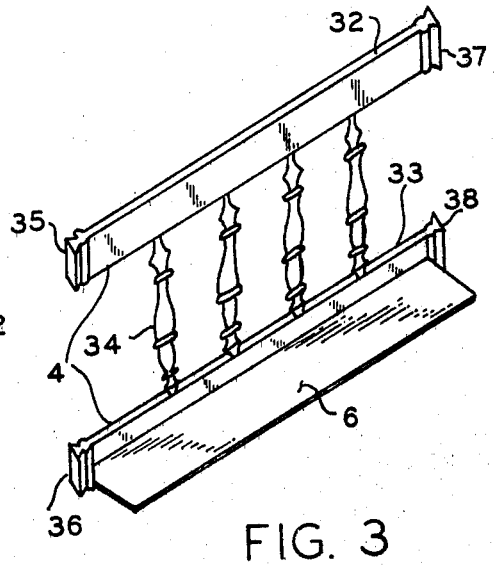
FIG. 3 is a perspective view of a side panel of the magazine rack shown in FIG. 1.

A more detailed view of the side panel 4 is shown in FIG. 3. In this embodiment the side panel 4 has been cut away so that the side article retaining surface 10 is formed by an upper slat 32, a lower slat 33, and a plurality of vertical connecting struts as at 34. The upper slat 32 and the lower slats 33 have, respectively, at their one end, dovetailed tongues 35 and 36 and at their other end dovetailed tongues 37 and 38. FIG. 3 also shows that base ledge 6 depends horizontally from lower slat 33. While side panel 5 is not shown in detail, it is noted that side panel 5 is identical in structure to side panel 4 as is shown in FIG. 3.

Figure 4:
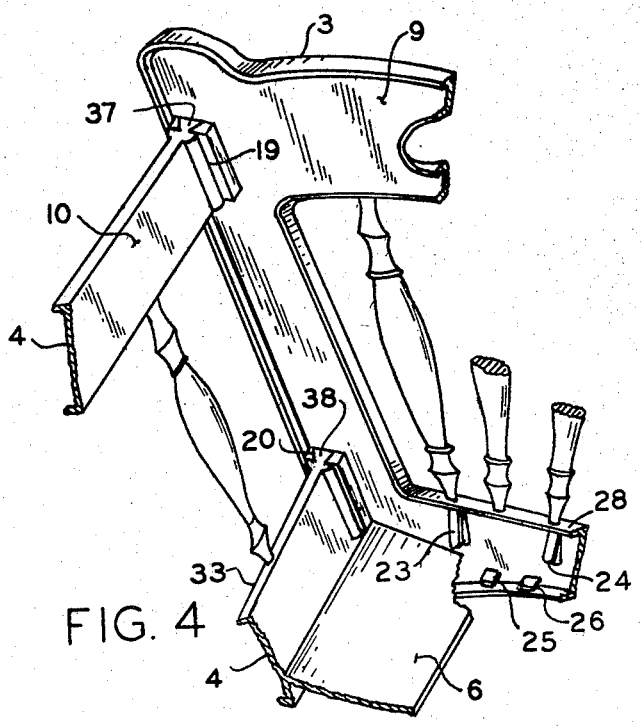
FIG. 4 is a detailed view of the magazine rack of the present invention showing the magazine rack in fragment and, in particular, the connection between an end panel and a side panel.

Referring to FIG. 4, the side panel 4 is connected to the end panel 3 by first simultaneously aligning the lower end of tongue 37 with the upper end of groove 19 and the lower end of tongue 38 with the upper end of groove 20. Downwardly directed pressure may then be applied to the side panel 4 so that the tongues 37 and 38 simultaneously engage with grooves 19 and 20. Such pressure will also cause the base ledge 6 to move downwardly toward the stop 25 and to press the resilient stop 23 against the lower slat 28. Such downward motion of the base ledge 6 continues until said ledge comes to rest against the stop 25, at which time it will also disengage with and release pressure on the resilient stop 23. Consequently, the resilient stop 23 will spring away from the lower slat 28 such that the terminal end of resilient stop 23 will bear on the upper surface of the base ledge 6. Because the base ledge 6 is retained between the resilient stop 23 and the stop 25, the entire side panel 4 will be prevented from being inadvertently displaced in either an upward or a downward direction.

The side panel 4 may be disengaged from the rear end panel 3 by pressing the resilient stop 23 against the rear article retaining surface 9 so that it no longer bears against the top surface of the base ledge 6. While the resilient stop 23 is retained in this position, the side panel may be moved in an upward direction until the tongues 37 and 38 are out of engagement with the grooves 19 and 20.

While the connection between the side panel 4 and the front end panel 2 is not shown in detail, this connection is effected in the same way as the connection illustrated in FIG. 4. Similarly, the connections between the front and rear end panels 2 and 3 and the side panel 5 are accomplished in the manner shown in FIG. 4. It is noted, in particular, that the resilient stop 24 and the stop 26 are positioned so as to retain the base ledge 7 and consequently the side panel 5 in the same manner as the resilient stop 23 and the stop 24 hold the base ledge 6.

Finally, the magazine rack of the present invention may be most satisfactorily constructed of a plastic material, such as a polyolefin, and particularly good results are obtainable with use of a polypropylene homopolymer. It will be appreciated that only two molds are required to manufacture the component parts of this magazine rack since the two end panels and the two side panels are identical to one another.

It will, therefore, be seen that a magazine rack is provided which may be economically manufactured from only two pairs of component parts without need of separate connecting means or adhesive and which may be readily disassembled into a form in which it may be efficiently stored or transported.

What is claimed is:

1. A rack for magazines and other paper articles which may be assembled separate fastening means, comprising:

(a) a pair of vertical end panels disposed in spaced relation so as to form opposed front and rear article retaining surfaces;

(b) a pair of spaced vertical side panels, each of said pair, being attached edgewise to said front and rear article retaining surfaces, and having an integral horizontal inwardly extending base ledge;

(c) lower stops protruding from both the front and rear article retaining surfaces below the base ledges such that the side panels are prevented from being downwardly displaced and resilient stops protruding from both the front and rear article retaining surfaces above the base ledges such that the resilient stops bear downwardly on the base ledge so as to prevent upward displacement of the side panels; and (d) a releasable connecting means having a tongue and groove for attaching said side panels and end panels together such that said side panels together form both opposed side article retaining surfaces and a base article retaining surface.

2. The rack of claim 1 wherein there are provided a pair of said lower stops and a pair of said resilient stops on each of said vertical end panels.

* * * * *